US006247899B1

(12) United States Patent
Ban et al.

(10) Patent No.: US 6,247,899 B1
(45) Date of Patent: Jun. 19, 2001

(54) DUAL DRIVEN HYBRID COMPRESSOR

(75) Inventors: Takashi Ban; Toshiro Fujii; Yoshiyuki Nakane, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/365,922

(22) Filed: Aug. 3, 1999

(30) Foreign Application Priority Data

Aug. 7, 1998 (JP) ..... 10-224951

(51) Int. Cl.[7] ..... F04B 49/00
(52) U.S. Cl. ..... 417/16; 62/175
(58) Field of Search ..... 417/16, 364, 405, 417/17; 62/228.5, 323.1, 175, 236, 323.3, 228.4, 226, 228.1

(56) References Cited

U.S. PATENT DOCUMENTS 4,531,379 * 7/1985 Diefenthaler, Jr. ..... 62/236
5,617,732 * 4/1997 Albader ..... 62/228.5
5,685,160 11/1997 Abersfelder et al. ..... 62/114
5,867,996 * 2/1999 Takano et al. ..... 62/175

FOREIGN PATENT DOCUMENTS 27 05 869 8/1978 (DE) .
195 13 710 10/1995 (DE) .
197 38 250 3/1999 (DE) .
57-159976 2/1982 (JP) .
5-187356 7/1993 (JP) .
6-087678 12/1994 (JP) .

* cited by examiner

*Primary Examiner*—Teresa Walberg
*Assistant Examiner*—L Fastovsky
(74) *Attorney, Agent, or Firm*—Morgan & Finnegan, LLP

(57) ABSTRACT

A hybrid compressor that is selectively driven by an engine and a motor. A compression mechanism includes a drive shaft. A clutch is attached to the front of the compression mechanism, and the motor is attached to the rear of the compression mechanism. The motor has an output shaft connected to the drive shaft. The clutch selectively transmits power from the engine to the drive shaft. This structure makes the hybrid compressor compact and reduces the imbalance of the load applied to its drive shaft.

14 Claims, 3 Drawing Sheets

DUAL DRIVEN HYBRID COMPRESSOR

BACKGROUND OF THE INVENTION

The present invention relates to a hybrid compressor mainly used for vehicle air-conditioning systems. More specifically, the present invention pertains to a hybrid compressor that is driven by a plurality of drive sources. The drive sources include an engine and an electric motor.

Generally, a vehicle air-conditioning system includes a refrigeration circuit, which includes a compressor and an external circuit connected to the compressor. When the compressor is driven by the engine, refrigerant circulates in the refrigeration circuit and cools the passenger compartment. Typically, the compressor is connected to a single drive source, or the vehicle's engine, through an electromagnetic clutch. When the cooling capacity of the refrigeration circuit becomes excessive as the thermal load on the refrigeration circuit decreases, the electromagnetic clutch is turned off and the operation of the compressor is temporarily stopped. When the engine is stopped, the compressor is not operated and the cooling function is stopped whether the electromagnetic clutch is turned on or off.

Japanese Unexamined Utility Model Publication No. 6-87678 describes a hybrid compressor that is driven by an engine and an electric motor. When the engine is stopped, the compressor can be driven by the motor to cool the passenger compartment.

The hybrid compressor includes a compression mechanism having a drive shaft, an electric motor, and an electromagnetic clutch. The electric motor has an output shaft joined to the drive shaft, and the clutch is connected to the output shaft. The engine is connected to the output shaft through the clutch. When the clutch is turned on, engine power is transmitted to the drive shaft through the output shaft, which operates the compressor. In this state, the output shaft of the motor rotates with the drive shaft of the compressor. The rotation of the output shaft generates electromotive force in the motor, and electric power based on the electromotive force is used to charge a battery. When the engine is stopped, the clutch is turned off and the output shaft (drive shaft) is disconnected from the engine, the motor, which is powered by the battery, drives the compressor.

In the hybrid compressor of the Japanese publication, the clutch and the motor are both attached to the front end of the compression mechanism. In detail, the motor is attached to the front end of the compression mechanism, and a pulley is provided to surround the electric motor. Power of the engine is transmitted to the pulley. The clutch is located between the pulley and the motor. This increases the size of the mechanism, which includes the motor, the pulley, and the clutch. The load of this large mechanism is applied to one end of the drive shaft of the compression mechanism. Since the drive shaft is supported by bearings, the unbalanced nature of the load applied to the bearings wears the bearings, which hinders smooth rotation of the drive shaft. As a result, noise is produced during operation.

In another prior art compressor, the electromagnetic clutch is attached to the front end of the compressor mechanism, and the electric motor is located on the front end of the clutch mechanism. In other words, the clutch is between the motor and the compression mechanism. However, in this case, the compression mechanism and the motor, which are independent, are respectively attached to a frame in the engine compartment. This complicates the installation of the compressor. Also, a large space is required to accommodate the compressor, since it has a large axial dimension.

An objective of the present invention is to provide a compact hybrid compressor that reduces the imbalance of the load applied to its drive shaft.

To achieve the above objective, the present invention provides a hybrid compressor that is selectively driven by an engine and a motor. A gas compression mechanism including a drive shaft. The compression mechanism has a first end and a second end The second end is opposite to the first end. The motor is fixed to the second end, and the motor has an output shaft connected to the drive shaft. A clutch is fixed to the first end of the compression mechanism. The clutch selectively transmits power from the engine to the drive shaft.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

A hybrid compressor according to one embodiment of the present invention will now be described with reference to FIGS. 1–3. As shown in FIGS. 1 and 3, the hybrid compressor includes a compression mechanism 1, an electromagnetic clutch 2 and an electric motor 4. The clutch 2 is attached to the front of the compression mechanism 1, and the motor 4 is attached to the rear of the compression mechanism 1. The clutch 2 is attached to a drive shaft 16A and selectively transmits power of an engine 3 to the drive shaft 16A. The motor 4 is powered by DC power source, which is a battery 5. A drive circuit 7 controls the supply of electric power from the battery 5 to the motor 4 in accordance with instructions from a controller 51. An electric current sensor 57 detects the value of the electric power supplied to the motor 4.

The compression mechanism 1 will now be described with reference to FIGS. 1 and 2. As shown in FIG. 1, the compression mechanism 1 includes a cylinder block 11, a front housing member 12, and a rear housing member 13. The front housing member 12 is joined to the front of the cylinder block 11, and the rear housing member 13 is joined to the rear of the cylinder block 11 through a valve plate 14. A crank chamber 15 is formed between the cylinder block 11 and the front housing member 12. The drive shaft 16A is rotatably supported in the cylinder block 11 and the front housing member 12 through bearings 17A, 17B.

A lug plate 18 is secured to the drive shaft 16A in the crank chamber 15. A swash plate 19 is inclinably and slidably supported on the drive shaft 16A. The swash plate 19 is coupled to the lug plate 18 by a hinge mechanism 20. The hinge mechanism 20 rotates the swash plate 19 together with the lug plate 18 and permits the swash plate to incline and slide with respect to the drive shaft 16A.

Figure 1:
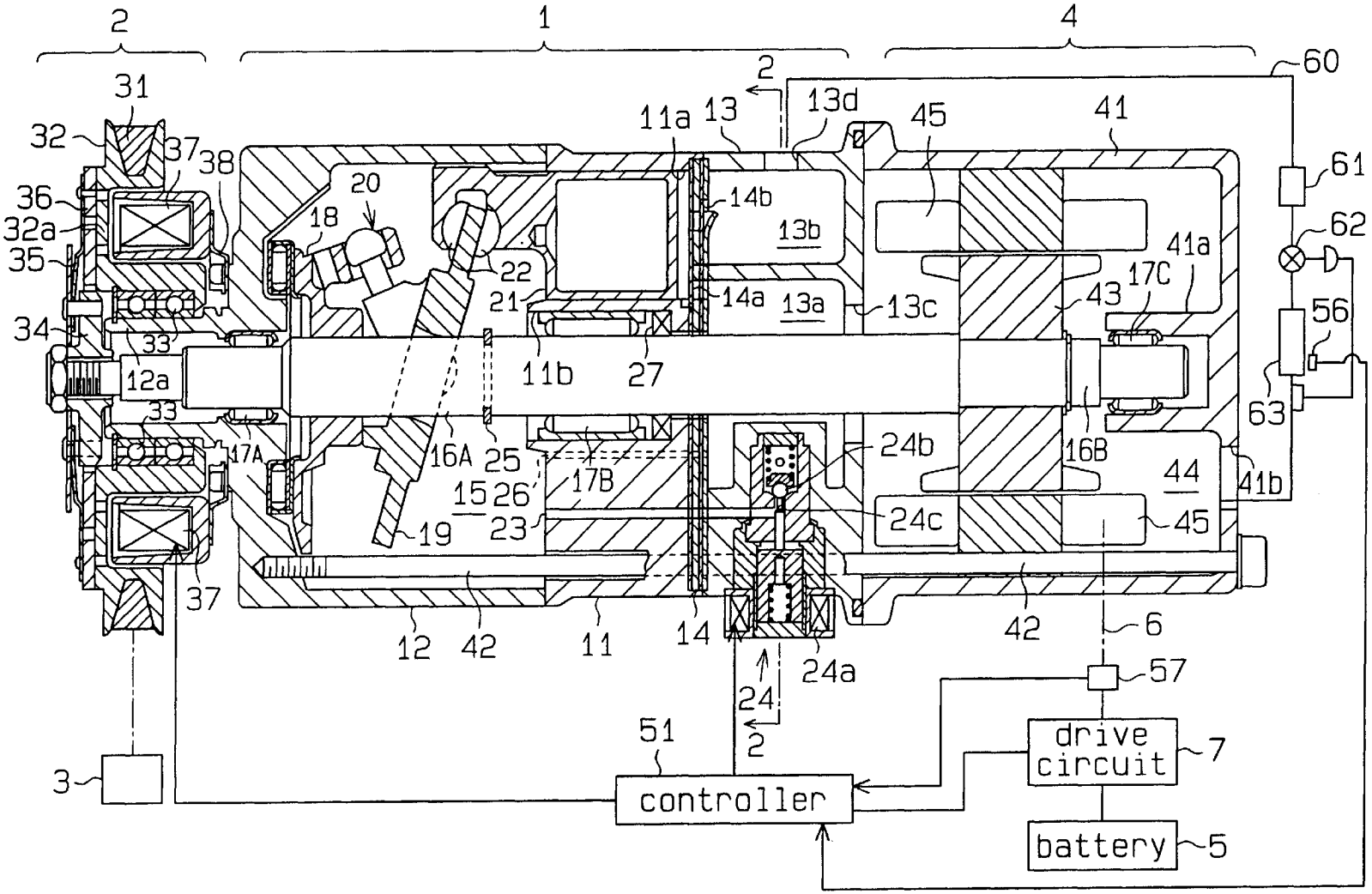
FIG. 1 is a cross sectional view showing a hybrid compressor according to one embodiment of the present invention.
Figure 2:
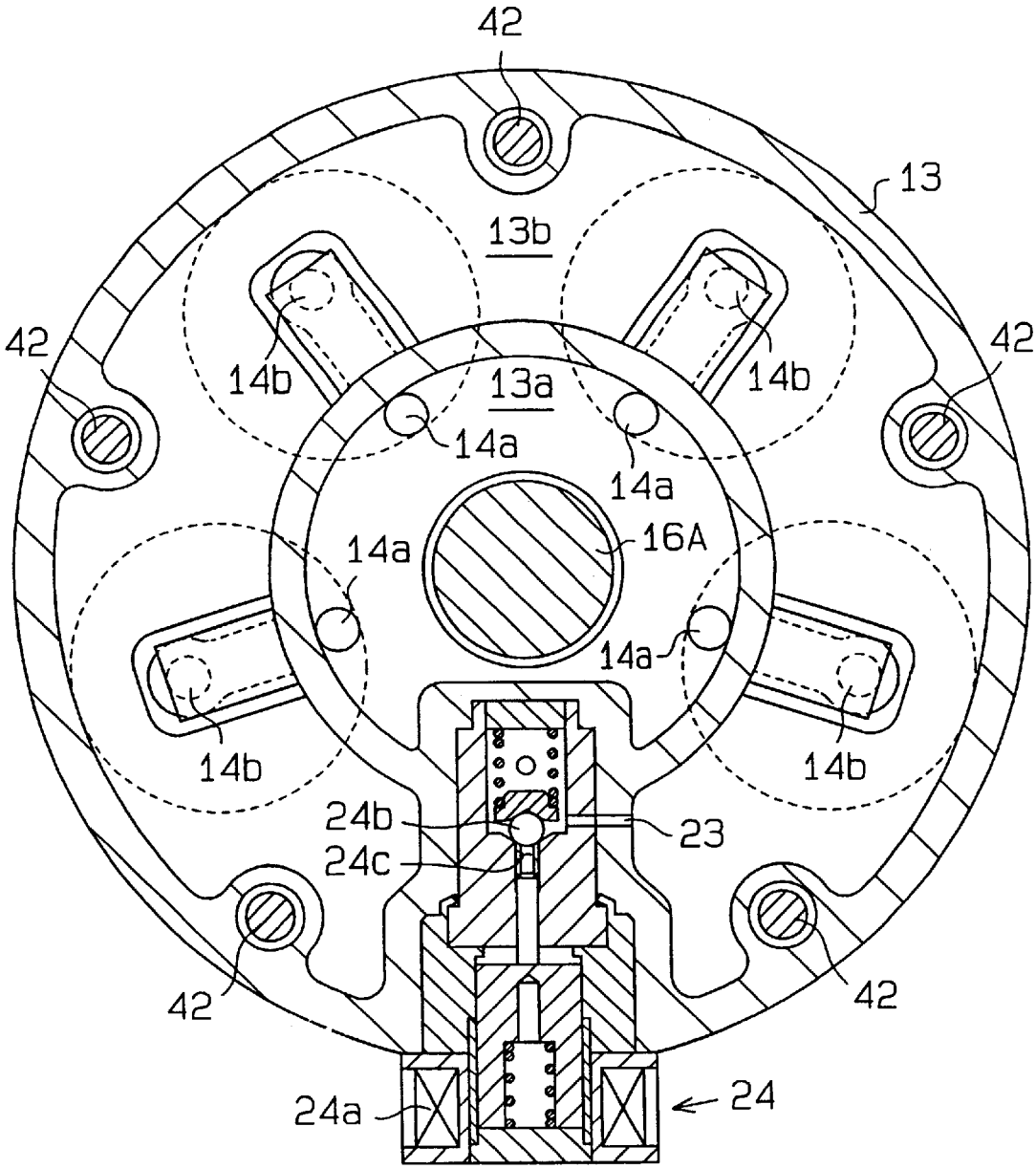
FIG. 2 is a cross sectional view taken on line 2–2 of FIG. 1.

As shown in FIGS. 1 and 2, cylinder bores 11*a* are formed in the cylinder block 11. A piston 21 is accommodated in each cylinder bore 11*a* and is coupled to the swash plate 19 through a corresponding pair of shoes 22. The swash plate 19 converts the rotation of the drive shaft 16A into reciprocation of each piston 21.

A generally annular suction chamber 13*a* is formed in the rear housing member 13. A generally annular discharge chamber 13*b* is also formed in the rear housing member 13 and surrounds the suction chamber 13*a*. The valve plate 14 includes suction valve mechanisms 14*a* and discharge valve mechanisms 14*b*, which respectively correspond to each cylinder bore 11*a*. Each suction valve 14*a* admits refrigerant gas from the suction chamber to the corresponding cylinder bore 11*a*. Each discharge valve mechanism 14*b* discharges compressed refrigerant gas from the corresponding cylinder bore 11*a* to the discharge chamber 13*b*.

A pressurizing passage 23 is formed in the cylinder block 11 and the rear housing member 13 to connect the discharge chamber 13*b* with the crank chamber 15. A displacement control valve 24 is located in the pressurizing passage 23 and is attached to the rear housing member 13. The control valve 24 includes a solenoid 24*a*, a spherical valve body 24*b*, and a valve hole 24*c*. The valve body 24*b* is operated by the solenoid 24*a* and opens/closes the valve hole 24*c*. When the solenoid 24*a* is de-excited, the valve body 24*b* opens the valve hole 24*c*, that is, opens the pressurizing passage 23. When the solenoid 24*a* is excited, the valve body 24*b* closes the valve hole 24*c*, that is, the valve body 24*b* closes the pressurizing passage 23.

As shown in FIG. 1, a bleed passage 26 is formed in the cylinder block 11 to connect the crank chamber 15 with the suction chamber 13*a*. The bleed passage bleeds refrigerant gas in the crank chamber 15 to the suction chamber 13*a* so that an excessive increase of pressure in the crank chamber 15 is cannot occur.

The cylinder block 11 includes an axial hole 11*b*, through which the drive shaft 16A passes. The bearing 17B is located in the axial hole 11*b*. The bearing 17B has a clearance that permits the flow of the refrigerant gas. Therefore, a seal 27 is provided in the axial hole 11*b* to prevent leakage of refrigerant gas from the crank chamber 15 to the suction chamber 13*a* through the axial hole 11*b*.

When the control valve 24 opens the pressurizing passage 23, high-pressure refrigerant gas is drawn from the discharge chamber 13*b* to the crank chamber 15 through the pressurizing passage 23, thus increasing the pressure in the crank chamber 15. As a result, the inclination of the swash plate 19 is reduced, which reduces the stroke of each piston 21 and the displacement of the compression mechanism 1.

A stopper 25 is fixed to the drive shaft 16A. When the swash plate abuts against the stopper 25, the swash plate 19 is positioned at a minimum inclination. The minimum inclination angle of the swash plate 19 is around ten degrees with respect to a plane perpendicular to the axis of the drive shaft 16A.

When the control valve 24 closes the pressurizing passage 23, the flow of refrigerant gas from the discharge chamber 13*b* to the crank chamber 15 is stopped. Since the refrigerant gas in the crank chamber 15 continues to flow to the suction chamber 13*a* through the bleed passage 26, the pressure in the crank chamber 15 decreases. As a result, the inclination of the swash plate 19 and the stroke of each piston 21 are increased, which increases the displacement of the compression mechanism 1. When the swash plate 19 abuts against the lug plate 18, the swash plate 19 reaches its maximum inclination.

The electromagnetic clutch 2 will now be described. As shown in FIG. 1, the clutch 2 includes a pulley 32. The pulley 32 is rotatably supported by the boss 12*a* at the front end of the front housing member 12 by a radial ball bearing 33. A belt 31 connects the pulley 32 to an engine 3. Power from the engine 3 is transmitted to the pulley 32 through the belt 31. Part of the pulley 32 constitutes a first clutch plate 32*a*. A disc-shaped bracket 34 is fixed to the front end of the drive shaft 16A. A ring-shaped second clutch plate 36 is attached to the bracket 34 by a leaf spring 35. The second clutch plate 36 is opposed to the first clutch plate 32*a*. A solenoid 37 is attached to the front of the front housing member 12 by stays 38 and is located on the opposite side of the pulley 32 from the second clutch plate 36.

When the solenoid 37 is excited, the second clutch plate 36 is attracted to the solenoid 37 and contacts the first clutch 32*a*. Accordingly, the rotation of the pulley 32 is transmitted to the drive shaft 16A to drive the compression mechanism 1 through the clutch plates 32*a*, 36, the leaf spring 35, and the bracket 34. When the solenoid 37 is de-excited, the second clutch plate 36 is separated from the first clutch plate 32*a*, which disconnects the transmission of power from the engine 3 to the drive shaft 16A.

The electric motor 4 will now be described. A motor housing 41 is joined to the rear of the rear housing member 13. As shown in FIGS. 1 and 2, bolts 42 fasten together the housing members 11, 12, 13 and the motor housing 41. The rear end of the drive shaft 16A passes through the rear housing 13 and is located in the motor housing 41. The part of the drive shaft 16A located in the motor housing 41 functions as an output shaft 16B of the electric motor 4. The rear end of the drive shaft 16A, or the end of the output shaft 16B, is supported by a cylindrical boss 41*a* through a radial bearing 17C. The cylindrical boss 41*a* is formed to the inner wall of the motor housing 41. A rotor 43 is fixed to the output shaft 16B. A stator coil 45 is attached the inner wall of the motor housing 41 to surround the rotor 43.

When electric current is supplied to the stator coil 45 from the battery 5, the output shaft 16B (drive shaft 16A) is rotated with the rotor 43, which operates the compression mechanism 1.

A through hole 13*c* for permitting the passage of the drive shaft 16A is formed in the rear wall of the rear housing member 13. The through hole 13*c* connects the suction chamber 13*a* to an inner space 44 of the motor housing 41. An inlet is formed in the rear wall of the motor housing 41 and connects an external circuit 60 to the inner space 44. An outlet 13*d* is formed in a peripheral portion of the rear housing 13 and connects the external circuit 60 to the discharge chamber 13*b*. Refrigerant gas is supplied from the external circuit 60 to the suction chamber 13*a* through the inlet 41*b*, the inner space 44, and the through hole 13*c*. Compressed refrigerant gas is discharged from the discharge chamber 13*b* to the external circuit 60 through the outlet 13*d*.

The external circuit 60 and the compressor constitute a refrigeration circuit for vehicle air conditioning. The external circuit 60 includes a condenser 61, an expansion valve 62, and an evaporator 63. A temperature sensor 56 detects temperature at the outlet of the evaporator 63 and outputs signals indicating the detection result to the controller 51. The temperature at the outlet of the evaporator 63 reflects a thermal load on the refrigeration circuit.

Figure 3:
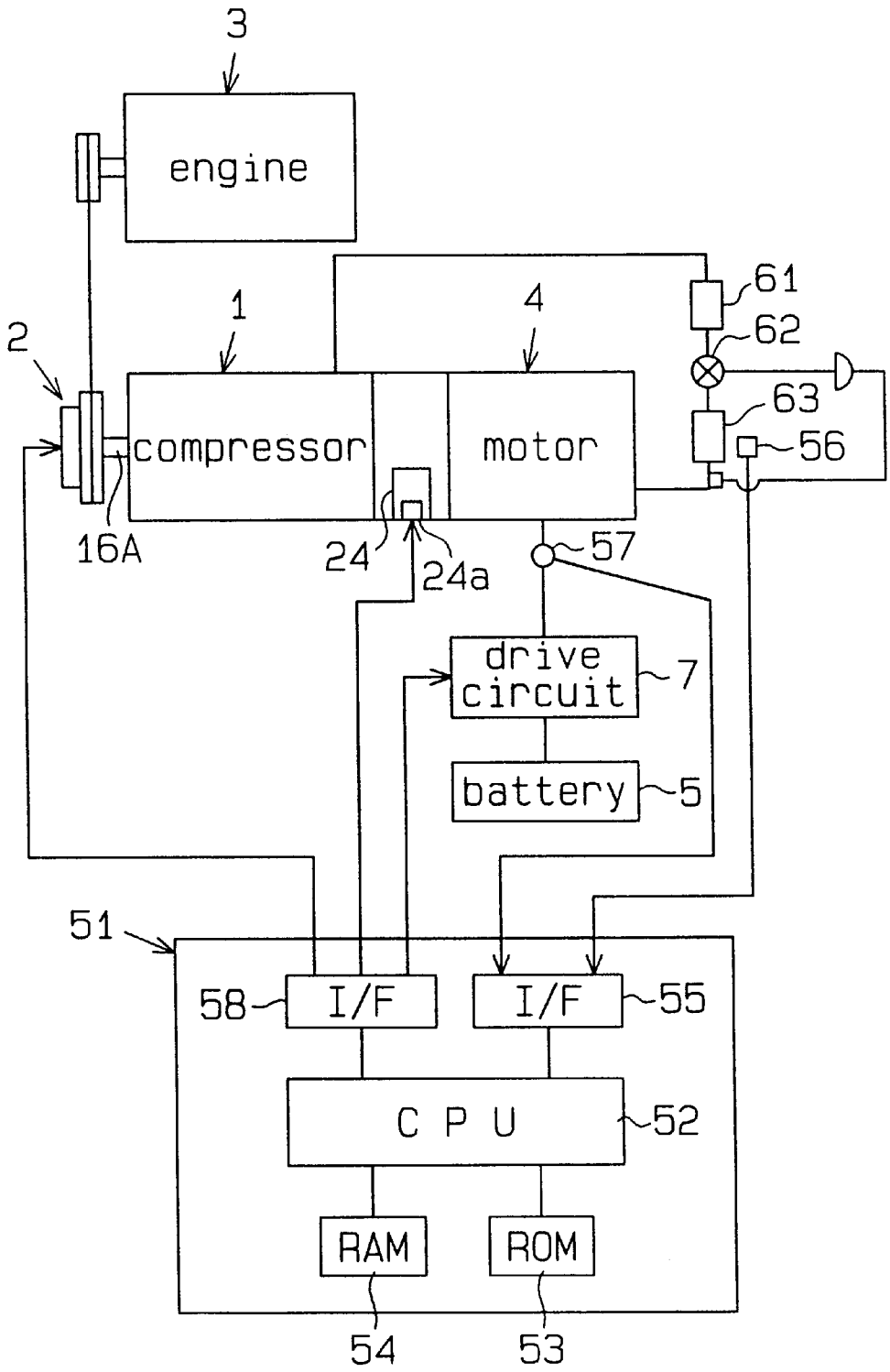
FIG. 3 is a block diagram illustrating the compressor and the controller of FIG. 1.

As shown in FIG. 3, the controller 51, which is a computer, includes a central processing unit (CPU) 52 for various computations, a read only memory (ROM) 53 for storing programs, and a random access memory (RAM) 54 for temporarily memorizing data. The detection signals from the temperature sensor 56 and an electric current sensor 57 are input to the CPU 52 through an input interface 55. The CPU 52 calculates the thermal load on the refrigeration circuit based on the temperature at the outlet of the evaporator 63 detected by the temperature sensor 56. The CPU 52 calculates torque of the motor 4 based on the value of electric current supply to the motor 4, which is detected by the electric current sensor 57. Also, the CPU 52 controls the solenoid 37 of the electromagnetic clutch 2, the solenoid 24*a* of the control valve 24, and the drive circuit 7 by way of the output interface 58.

A method for controlling the hybrid compressor will now be described. When the engine is running, the controller 51 engages the clutch 2 and instructs the drive circuit 7 to stop the supply of electric current from the battery to the motor 4. Accordingly, the engine 3 drives the compression mechanism 1.

While the compression mechanism 1 is driven by the engine 3, the controller 51 controls the control valve 24 in accordance with the temperature detected by the sensor 56 at the outlet of the evaporator 63, or the thermal load on the refrigeration circuit. When the thermal load is above the predetermined value, the controller 51 judges that the cooling capacity of the refrigeration circuit is insufficient. Then, the controller 51 closes the control valve 24 by feeding electric current to the solenoid 24*a*. Accordingly, the supply of refrigerant gas from the discharge chamber 13*b* to the crank chamber 15 through the pressurizing passage 23 is stopped, which reduces the pressure in the crank chamber 15. As a result, the inclination of the swash plate 19 increases, which increases the displacement of the compression mechanism 1.

When the thermal load on the refrigeration circuit is below the predetermined value, the controller 51 judges that the cooling capacity of the refrigeration circuit is excessive and opens the control valve 24 by stopping the supply of electric current. Accordingly, refrigerant gas is supplied from the discharge chamber 13*b* to the crank chamber 15 through the pressurizing passage 23, which increases the pressure in the crank chamber 15. As a result, the inclination of the swash plate 19 decreases, which decreases the displacement of the compression mechanism 1.

Alternatively, the controller may perform duty-cycle control to control the electric current supplied to the control valve 24 in accordance with the thermal load on the refrigeration circuit. By changing the duty cycle, the excitation time of the control valve 24 to the de-excitation time is changed. In other words, the ratio of closing time of the pressurizing passage 23 to the opening time is changed, which adjusts the flow rate of refrigerant gas in the pressurizing passage. In this way, the inclination of the swash plate 19 is adjusted to an arbitrary inclination between the minimum inclination and the maximum inclination. Accordingly, the displacement of the compression mechanism 1 is adjusted to an arbitrary displacement between the maximum displacement and the minimum displacement in accordance with the thermal load of the refrigeration circuit.

When the drive shaft 16A of the compression mechanism 1 is driven by the engine 3, the output shaft 16B of the motor 4 rotates with the rotor 43. The rotation of the rotor 43 generates electromotive force in the stator coil 45, and electric power based on the electromotive force charges the battery 5.

When the engine 3 is stopped, the controller 51 turns off the clutch 2 and separates the drive shaft 16A of the compression mechanism 1 from the engine 3. Simultaneously, the controller 51 controls the drive circuit 7 to supply electric current from the battery 5 to the motor 4. Therefore, the output shaft 16B of the motor 4 rotates and drives the compression mechanism.

When the compression mechanism 1 is driven by the engine 3, the engine speed cannot be varied for the sake of the refrigeration circuit. Therefore, the displacement of the compressor mechanism, or the cooling capacity of the refrigeration circuit, is adjusted by controlling the inclination of the swash plate 19. In contrast, when the compression mechanism 1 is driven by the motor 4, the cooling capacity of the refrigeration circuit is adjusted by controlling the inclination of the swash plate 19 and the rotation speed of the motor 4.

That is, the controller 51 adjusts the inclination of the swash plate 19 and the rotation speed of the motor 4 by controlling the control valve 24 and the drive circuit 7 so that the compression mechanism 1 and the motor 4 are most efficiently operated to achieve the required cooling capacity. During this adjustment, the controller 51 considers not only the detection signal of the temperature sensor 56 (thermal load on the refrigeration circuit) but also the torque of the motor and other conditions. As a result, the compressor operates efficiently and avoids excessive load on the motor 4 while minimizing the power consumption of the motor 4.

When the engine 3 is restarted, the controller 51 turns on the clutch 2 and instructs the drive circuit 7 to stop the supply of electric current to the motor 4. Accordingly, the operation of the compression mechanism 1 is restarted by the engine 3, and the battery is charged again by the electromotive force generated in the motor 4.

The illustrated hybrid compressor has the following advantages.

(1) The clutch 2 is attached to the front end of the compression mechanism 1, and the motor 4 is attached to the rear end of the compression mechanism 1. Accordingly, unlike the prior art compressor, the load applied to the drive shaft 16A of the compression mechanism 1 is more balanced. Accordingly, wear of the bearings 17A, 17B, 17C and vibration resulting from the wear are prevented, which suppresses noise. Also, the structure of the compressor is simplified and the size of the compressor is reduced. The compressor is installed in the engine compartment as simply as a typical compressor that does not have a motor 4.

(2) The output shaft 16B of the motor 4 forms part of the drive shaft 16A of the compression mechanism 1. This reduces the number of parts and facilitates manufacturing and installation of the compressor.

(3) The inner space 4 of the motor 4 functions as a passage for introducing refrigerant gas from the external circuit 30 to the suction chamber 13*a*. The refrigerant gas from the external circuit 30 has a relatively low temperature, and the refrigerant gas passing through the inner space prevents excessive heating of the motor 4.

(4) The rear wall of the rear housing member 13 of the compression mechanism 1 also serves as the front wall of the motor housing 41. This reduces the weight of the compressor.

(5) The housing members 11, 12, 13, and the motor housing 41 are fastened integrally by the bolts 42. This simplifies the structure of the compressor housing and facilitates installation.

The present invention can be further varied as follows.

The middle bearing 17B of the drive shaft 16A may be omitted, and only the ends of the drive shaft 16A may be supported by the two bearings 17A, 17C. This also simplifies the compressor.

In the embodiment of FIG. 1, the output shaft 16B of the motor 4 forms part of the drive shaft 16A of the compression mechanism 1. However, the output shaft 16B may be an independent part and may be coupled to the drive shaft 16A by a coupler.

In the embodiment of FIG. 1, refrigerant gas is drawn from the external circuit 60 to the suction chamber 13*a* through the inner space 44 of the motor 4. Instead, an inlet from the external circuit 60 in the suction chamber 13*a* may be formed to the rear housing member 13, bypassing the internal space 44 of the motor 4.

In the compressor of FIG. 1, the displacement of the compressor is varied by varying the stroke of the pistons 21 according to the inclination angle of the swash plate 19. However, the present invention may be embodied in other types of compressors, such as, fixed displacement piston type compressors, variable displacement vane type compressors or variable displacement scroll type compressors.

It should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope and equivalence of the appended claims.

What is claimed is:

1. A hybrid compressor that is selectively driven by an engine and a motor, the hybrid compressor comprising:

a gas compression mechanism including a drive shaft, wherein the compression mechanism has a first end and a second end, wherein the second end is opposite to the first end, wherein the motor is fixed to the second end, and the motor has an output shaft connected to the drive shaft; and a clutch fixed to the first end of the compression mechanism, wherein the clutch selectively transmits power from the engine to the drive shaft.

2. The hybrid compressor according to claim 1, wherein the drive shaft extends from the second end of the compression mechanism to the motor such that the drive shaft serves as the output shaft of the motor.

3. The hybrid compressor according to claim 1, wherein each of the compression mechanism and the motor includes a bearing that rotatably supports the drive shaft.

4. The hybrid compressor according to claim 1, wherein the compression mechanism has a suction chamber, which receives refrigerant gas from an external circuit, wherein the motor has an inner space, which is connected with the external circuit, wherein refrigerant gas is directed to the suction chamber through the inner space from the external circuit.

5. The hybrid compressor according to claim 1, wherein the compression mechanism includes a housing, wherein the motor includes a housing having an opening, wherein the housing of the motor is fixed to the housing of the compression mechanism such that the housing of the compression mechanism closes the opening.

6. The hybrid compressor according to claim 1, wherein the compression mechanism and the motor are held together by a bolt.

7. The hybrid compressor according to claim 1, wherein the compression mechanism comprises;

a housing for supporting the drive shaft and for defining a crank chamber, a swash plate supported by the drive shaft in the crank chamber, a piston connected to the swash plate, wherein the piston is reciprocated by movement of the swash plate; and an adjustment mechanism for adjusting the pressure in the crank chamber, wherein the inclination of the swash plate varies according to the pressure in the crank chamber, and the swash plate varies the stroke of the piston according to the inclination such that the swash plate varies the displacement of the compression mechanism.

8. The hybrid compressor according to claim 7, wherein the hybrid compressor includes a controller, which controls the adjustment mechanism and the motor, wherein the controller controls the adjustment mechanism to control the displacement of the compression mechanism if the compression mechanism is driven by the engine, and wherein the controller controls the rotation speed of the motor and the adjustment mechanism to control the displacement of the compression mechanism if the compression mechanism is driven by the motor.

9. A hybrid compressor that is selectively driven by an engine and a motor, wherein the hybrid compressor is used in vehicle air conditioners, the hybrid compressor comprising:

a gas compression mechanism including a drive shaft, the mechanism comprising a housing supporting the drive shaft and defining a crank chamber, a swash plate supported by the drive shaft in the crank chamber, a piston connected to the swash plate, wherein the piston is reciprocated by movement of the swash plate, and an adjustment mechanism for adjusting the pressure in the crank chamber. wherein the inclination of the swash plate varies according to the inclination such that the swash plate varies the displacement of the compression mechanism; and a clutch for selectively transmitting power of the engine to the drive shaft, wherein the compression mechanism is located between the motor and the clutch, wherein the drive shaft serves as the output shaft of the motor.

10. The hybrid compressor according to claim 9, wherein each of the compression mechanism and the motor includes a bearing that rotatably supports the drive shaft.

11. The hybrid compressor according to claim 9, wherein the compression mechanism has a suction chamber, which receives refrigerant gas from an external circuit, wherein the motor has an inner space, which is connected to the external circuit, wherein gas is directed to the suction chamber through the inner space from the external circuit.

12. The hybrid compressor according to claim 9, wherein the compression mechanism includes a housing, wherein the motor includes a housing having an opening, wherein the housing of the motor is fixed to the housing of the compression mechanism such that the housing of the compression mechanism closes the opening.

13. The hybrid compressor according to claim 9, wherein the compression mechanism and the motor are held together by a bolt.

14. The hybrid compressor according to claim 9, wherein the hybrid compressor includes a controller, which controls the adjustment mechanism and the motor, wherein the controller controls the adjustment mechanism to control the displacement of the compression mechanism if the compression mechanism is driven by the engine, and wherein the controller controls the rotation speed of the motor and the adjustment mechanism to control the displacement of the compression mechanism if the compression mechanism is driven by the motor.

* * * * *